US005645322A

United States Patent [19]

Hsu et al.

[11] Patent Number: 5,645,322

[45] Date of Patent: Jul. 8, 1997

[54] IN-SITU CHEMICAL REACTOR FOR RECOVERY OF METALS AND SALTS

[75] Inventors: Kenneth Hsu; Peter Hsu, both of Zurich, Switzerland; Frank W. Dickson, Sparks, Nev.

[73] Assignee: Tarim Associates for Scientific Mineral & Oil Exploration, Zurich, Switzerland

[21] Appl. No.: 403,364

[22] Filed: Mar. 14, 1995

[51] Int. Cl.[6] ..... B01D 37/00; E21B 43/241; E21B 43/247; E21B 43/28

[52] U.S. Cl. ..... 299/5; 166/259; 166/260; 166/261; 210/747

[58] Field of Search ..... 166/259, 260, 166/261; 210/747; 299/3, 4, 5; 405/58

[56] References Cited

U.S. PATENT DOCUMENTS

| | | | |
|---|---|---|---|
| 3,309,140 | 3/1967 | Gardner et al. | 299/5 X |
| 3,501,201 | 3/1970 | Closmann et al. | 299/5 X |
| 3,661,423 | 5/1972 | Garrett | 299/2 |
| 3,894,769 | 7/1975 | Tham et al. | 299/5 |
| 4,043,595 | 8/1977 | French | 299/2 |
| 4,085,971 | 4/1978 | Jacoby | 299/4 |
| 4,113,313 | 9/1978 | Terry | 299/4 |
| 4,162,808 | 7/1979 | Kvapil et al. | 299/2 |
| 4,192,552 | 3/1980 | Cha | 299/2 |
| 4,210,366 | 7/1980 | Hutchins et al. | 299/2 |
| 4,239,286 | 12/1980 | Coursen | 299/4 |
| 4,243,100 | 1/1981 | Cha | 299/2 X |
| 4,260,192 | 4/1981 | Shafer | 299/5 |
| 4,369,842 | 1/1983 | Cha | 166/251 |
| 4,381,873 | 5/1983 | Johnson et al. | 299/5 |
| 4,436,344 | 3/1984 | Forgac et al. | 299/2 |
| 4,444,256 | 4/1984 | Shen | 166/259 |
| 4,444,258 | 4/1984 | Kalmar | 166/261 |
| 4,475,772 | 10/1984 | Jan | 299/5 |
| 4,478,282 | 10/1984 | Nolte et al. | 166/281 |
| 4,487,260 | 12/1984 | Pittman et al. | 166/259 |
| 4,522,260 | 6/1985 | Wolcott, Jr. | 166/245 |
| 4,522,265 | 6/1985 | Yen et al. | 166/307 |
| 4,789,486 | 12/1988 | Ritter | 210/747 |
| 4,869,322 | 9/1989 | Vogt, Jr. et al. | 166/280 |
| 5,159,979 | 11/1992 | Jennings, Jr. | 166/280 |
| 5,228,510 | 7/1993 | Jennings, Jr. et al. | 166/263 |
| 5,362,400 | 11/1994 | Martinell | 210/747 X |
| 5,484,535 | 1/1996 | Downs | 210/747 X |

FOREIGN PATENT DOCUMENTS

| | | |
|---|---|---|
| 1482024 | 8/1977 | United Kingdom . |

*Primary Examiner*—George A. Suchfield
*Attorney, Agent, or Firm*—Helfgott & Karas, P.C.

[57] ABSTRACT

An "in-situ reactor" is provided to facilitate recovery of metals and salts such as potassium, lithium, gold from salt-bearing natural waters, sediments, and rocks by passing a fluid containing such metals and salts through a reactive chemical bed placed at the bottom of a reactor, the metal and salt bearing fluid flowing through the reactive chemical bed to react with the active components to produce a fluid from which the metals and salts can be more easily extracted.

12 Claims, 4 Drawing Sheets

IN-SITU CHEMICAL REACTOR FOR RECOVERY OF METALS AND SALTS

BACKGROUND OF THE INVENTION

This invention relates to the recovery of valuable metals and mineral salts from fresh and salt water bodies and from various sedimentary deposits and rocks.

Valuable metals and salts are found in nature either as minerals in sediments and/or rocks or as dissolved ions in fresh water and/or brine. Ores have to be processed physically and chemically to produce commercial products. Normally the ores are mined, milled, and refined in factories.

In arid regions such as the Qaidam Basin of Northwest China or in the Dead Sea region of Israel, the potassium-rich brines are mostly chloride brines, and they are also enriched with magnesium, sodium, and other ions. The current methods of recovering potassium from such brines have the disadvantage that the final product of evaporation, after NaCl is removed, is a potassium mixed salt ($KCl.MgCl_2 \cdot 6H_2O$). KCl has to be separated from the mixture in a factory, and the refining process is costly. Furthermore, the final product is not always pure enough to be used as a chemical fertilizer.

SUMMARY OF THE INVENTION

It has now been discovered that valuable products can be directly obtained by in-situ mining without having to resort to excavation and milling, and with a minimum of factory refining. The invention of the "in-situ reactor" makes it possible to remove magnesium ions from brines so that commercially pure KCl can be precipitated directly from brine through evaporation. Not only is the process more economical, but a further advantage is that the KCl so precipitated is sufficiently pure to be used as chemical fertilizer.

The invention is directed to a process for the economic recovery of metals from fresh water, brine and unconsolidated sediments or from rocks. The process provides for recovery of ores in-situ through chemical reaction of a metal-bearing (or metal-extracting) fluid and a solid in a in-situ reactor. The fluid flows through the in-situ reactor under a hydrodynamic gradient. The ore in the fluid can be fractionated or the metal in the solid can be extracted by chemical reaction between the fluid and solid phases.

The invention is particularly suitable for the recovery of potassium and lithium from brine in certain arid regions, such as Northwest China, Israel, Chile, Bolivia, and western North America, or for the mining of gold and other metals found in dark or organic-rich shales, such as those in the Carlin (Nev.) type of gold bearing deposits. The invention further optimizes the efficiency of a chemical exchange in in-situ reactors as fluid is induced to mainly move vertically upward through a chemical filter layer, with a resultant faster flow rate because the cross-sectional area A of such vertical flow is much larger than that of lateral fluid movement of in-situ mining processes currently in use.

The type of "in-situ reactor" employed depends on whether the metal or salt is present in solid form or as dissolved ions in solution.

If the metal or salt is contained in sediment or rock, the metal bearing rock is converted into an "in-situ reactor," so that the metal in the reactor can be dissolved by an injected fluid which is induced to flow vertically upward into collecting ponds, where the fluid is pumped out for refining by conventional methods.

BRIEF DESCRIPTION OF THE DRAWINGS

Referring to FIGS. 1 and 2 of the drawings, the figures show a cross-section of the strata in an in-situ reactor 10 wherein 11 is a layer of salt and/or sediment, 12 is a sand aquifer, 13 is the bed or base of the reactor and 14 is water, $h_0$=the height of the groundwater table;

$h_1$=the height of the water-level in the in-situ reactor;

$h_2$=the height of the bottom of the pond; and $h_4$=the height of the sand (aquifer).

Figure 2:
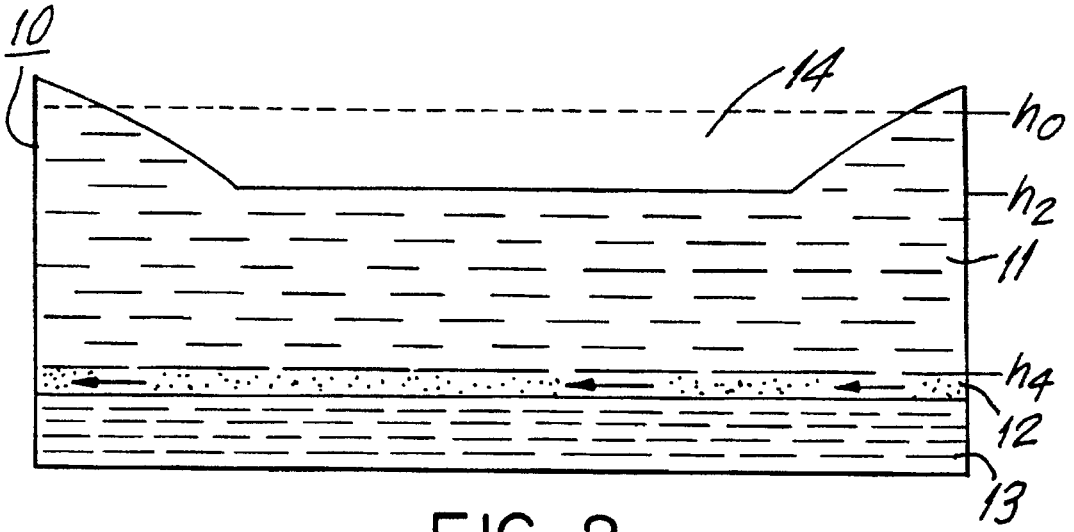
FIG. 2 is a cross-sectional view of an in-situ reactor suitable for use in processing ore bearing fluids.
Figure 3:
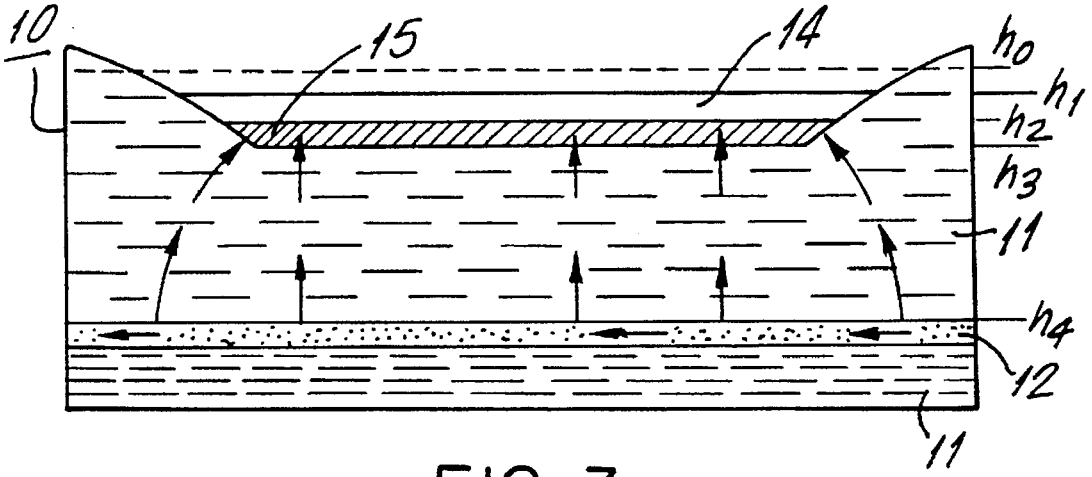
FIG. 3 is a cross-sectional view of the reactor of FIG. 2 showing the chemical filter layer in place.

Referring to FIG. 3 of the drawings, the figure shows the in-situ reactor of FIG. 2 with chemical filter layer 15 in place, $h_0$=the height of the groundwater table;

$h_1$=the height of the water level in the in-situ reactor;

$h_2$=the height of the surface of the chemical layer in the reactor;

$h_3$=the height of the bottom of the reactor;

$(h_0-h_1):(h_2-h_4)$=the hydrodynamic gradient;

$(h_1-h_2)$=the water depth in the reactor;

$(h_2-h_3)$=the thickness of the chemical filter layer in the reactor;

$(h_0-h_3)$=the depth of the excavation pit;

$h_4$=the height of the upper surface of an aquifer;

$h_2-h_4$=the distance of fluid movement through the reactor; and

K=transmissibility, an empirical constant with a value related to the permeability of the porous medium through which fluid flows.

Figure 5:
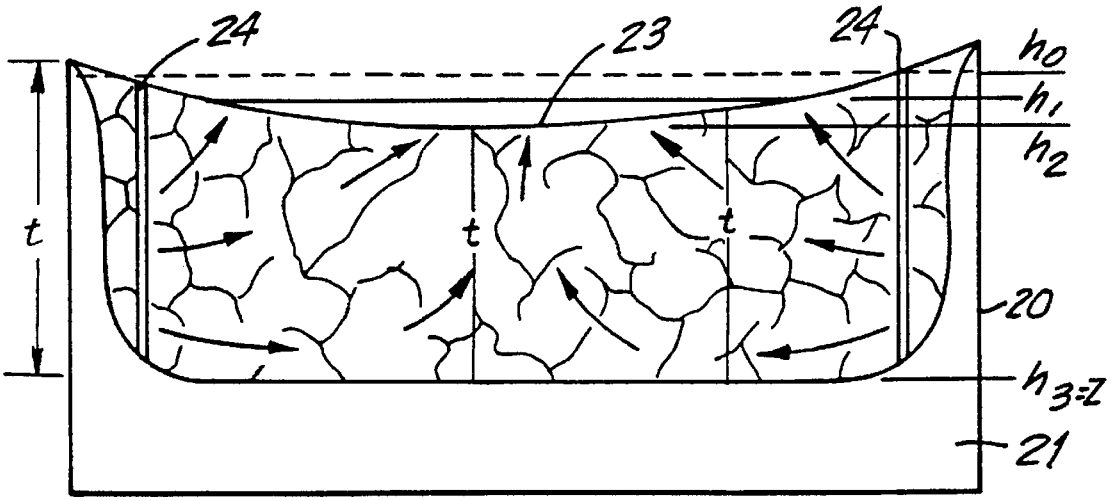
FIG. 5 is a cross-sectional view of an in-situ reactor suitable for use in processing solid, ore bearing rock.
Figure 6:
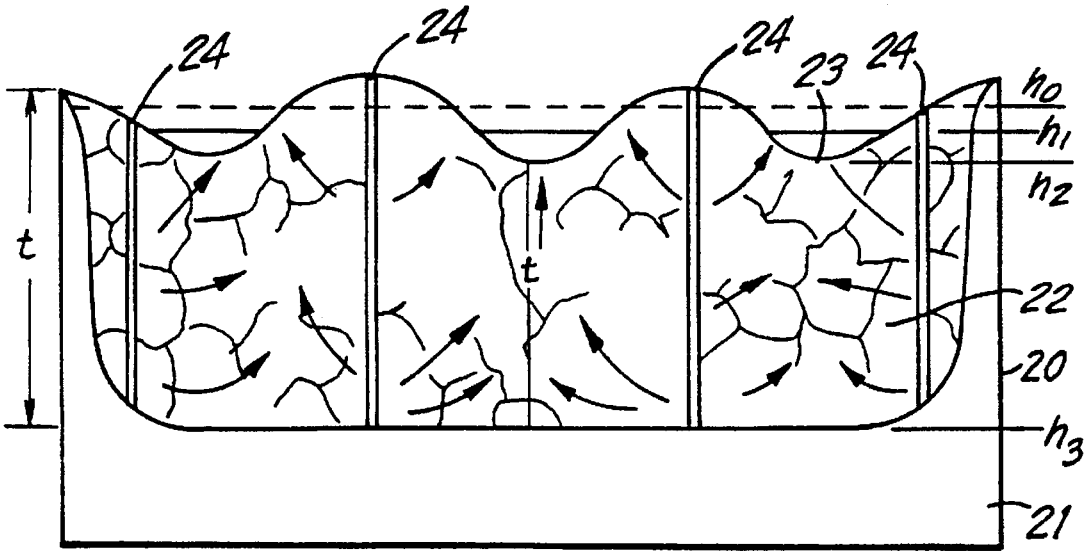
FIG. 6 is a cross-sectional view of a variation of the in-situ reactor shown in FIG. 5.

Referring to FIGS. 5 and 6 of the drawings, the figures show an in-situ reactor 20 for use in processing solid, ore bearing rock wherein 21 is the bed rock, 22 is the water permeable processing zone which may also contain oxidized stone or rock, 23 is water (a pond) and 24 are bore holes, $h_0$=the height of the groundwater table;

$h_1$=the height of the water level in the in-situ reactor;

$h_2$=the height of the bottom of the pond;

$h_3$=Z=the height in meters of the bottom of the reactor;

$(h_0-h_1):(h_2-h_3)$=the hydrodynamic gradient;

$h_1-h_2$=the water depth in the reactor;

$h_2h_3$=the vertical distance of the water or fluid movement; and

K=transmissibility, an empirical constant with a value related to the permeability of the host rock through which fluid flows; and t=the thickness of the zone of rocks from below the surface at that point to the depth z ($h_3$).

DESCRIPTION OF THE PREFERRED EMBODIMENTS

Figure 1:
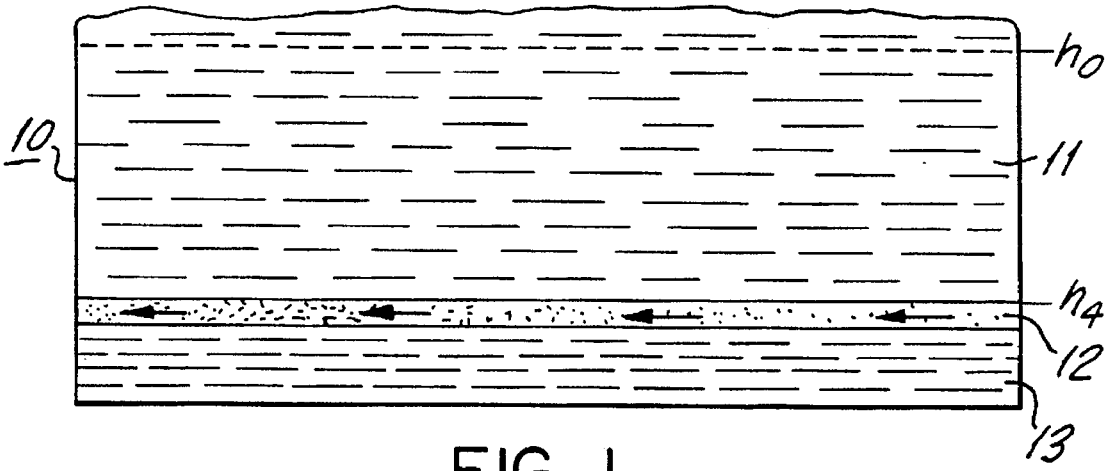
FIG. 1 is a cross-sectional view of the strata at the site of an in-situ reactor suitable for use in processing ore bearing fluids.

If the metal or salt is contained in fresh water or brine in an "in-situ reactor" may be constructed so that the composition of the groundwater or brine is modified as it flows upward into and filters through a reactive chemical filter layer. The reactor in this case is an open pit 10 having its bottom below the local water table 14 (FIGS. 1 and 2). The bottom of the pit is lined with the chemical filter 15 layer which, in some instances, may cover a layer of salt and/or sediment 11 or gravel or gravelly sand 12 (FIG. 3). The composition of chemical filter layer 15 selected for in-situ reactor 10 is determined by the ionic-fractionation desired. The chemical employed is dependent upon whether:

(1) the metal to be recovered is extracted by the chemical as the fluid is filtered through the chemical filter layer; or (2) one or more undesirable ions are extracted or exchanged and thus removed from the solution by the chemical as the fluid is filtered through the chemical filter layer.

In the first instance, the metal extracted by the chemical filter layer can be taken out of the in-situ reactor and refined by conventional means. In the second instance, the metal-bearing fluid, with one or more undesirable ions removed from the solution, can be introduced to other facilities where the metal is recovered by conventional means. The purpose of effecting chemical reactions in an in-situ reactor is to minimize the need for factory refining and thus to reduce production costs.

The in-situ reactor is constructed so that the flow rate can be varied to effect optimum chemical reaction between a fluid and a solid as the fluid flows through solid. The flow rate Q, or volume per unit time, depends upon three factors, namely:

i) the transmissibility of the flow K;

ii) the hydrodynamic gradient of the flow, $(h_0-h_1)/(h_2-h_4)$, where $h_0$ is the height of groundwater table, $h_1$ the height of the water level within the pit, $h_2$ the height of the surface level of the chemical layer in the pit, and $h_4$ the height of the source bed (aquifer) of the water or brine, as noted in FIG. 3;

iii) the cross-sectional area A normal to the path of flow.

The rate is determined by the Darcy-Hubbert-Hsu formula $$Q=K((h_0-h_1)/(h_2-h_4))\,A.$$

The in-situ reactors are so-designed that the flow rate is to be regulated through adjustment of the three factors.

The hydrodynamic gradient of the in-situ reactors can be easily regulated. The hydrodynamic potential difference $(h_0-h_1)$ can be varied through a change of $h_1$ when fluid is being pumped out of the in-situ reactor so that the fluid-level within the reactor ($h_1$) stands at the level desired, or through an increase of potential height $h_0$ when fluid is pumped under increased hydraulic pressure into a gravel layer at the base of the "in-situ reactor."

The transmittability factor K is related to the permeability of the solid, or solid mixture in the filter. Transmittability is necessarily changed because of chemical reaction within in-situ reactors. The permeability of the chemical filter layer in the in-situ reactor could, however, be maintained or even increased by a mixing of soluble salt with the chemical in the reactor, or through other means.

To recover metals (e.g., gold or uranium) from black shale or oil shale, leaching fluid must be injected into a host rock which is permeable and oxidized. The fracturing and shale-burning methods, which have until now been applied only to oil production to render the metalliferous host rocks oxidized and permeable, are used for the recovery of metals from black shale, or oil shale.

In selecting water supplies for production of KCl and lithium carbonate production, as adapted for local conditions in the Qaidam Basin of China, it is preferred that the area to be selected is one where the sulfate concentration is low. The brine should be essentially a chloride of Mg, K, and Na, with a high lithium content.

Since the production requires substantial freshwater or slightly brackish water to dilute the brines during production, a borehole is drilled to an aquifer below the surface in the selected region and the water is stored in an adjacent reservoir.

The procedures employ chemical fractionation in evaporating ponds and/or in in-situ reactors. For recovering K and Li from Mg rich chloride brines, the following ponds and reactors, numbered according to their functional utility, are employed.

In-situ Reactor 1 serves to remove Mg by chemical reaction

In-situ Reactor 2 serves to convert chloride solution into bicarbonate/chloride solution.

Evaporating Pond 1 serves to precipitate NaCl from brines

Evaporating Pond 2 serves to precipitate KCl from brines

Evaporating Pond 3 serves to precipitate K/Mg mixed salt from brines

Evaporating Pond 4 serves to precipitate Mg as chloride from brines

Evaporating Pond 5 serves to precipitate mixed salts enriched in Li

Figure 4A:
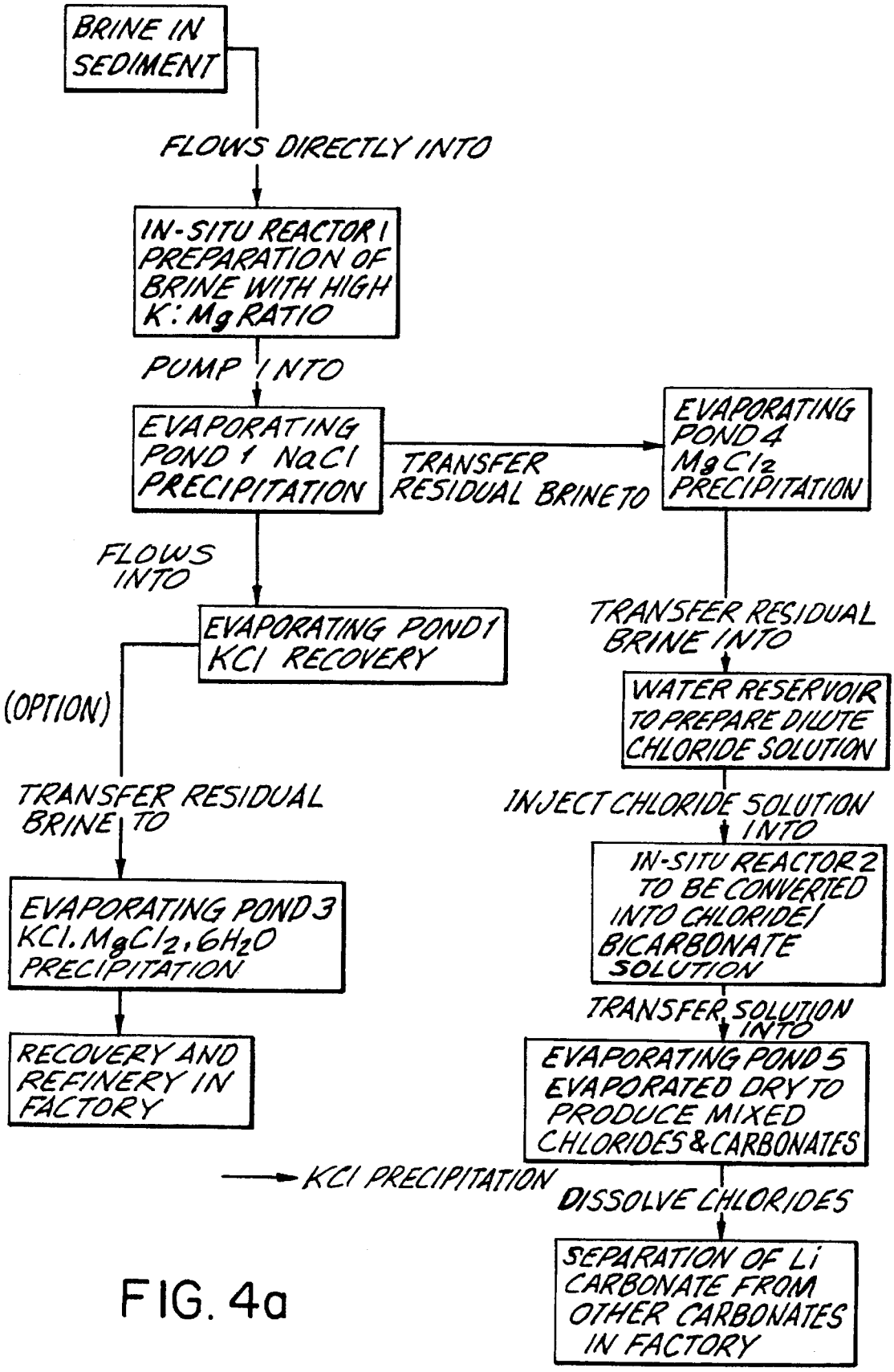
FIG. 4*a* is a flow chart showing the treatment of brine (high K/Mg ratio).
Figure 4B:
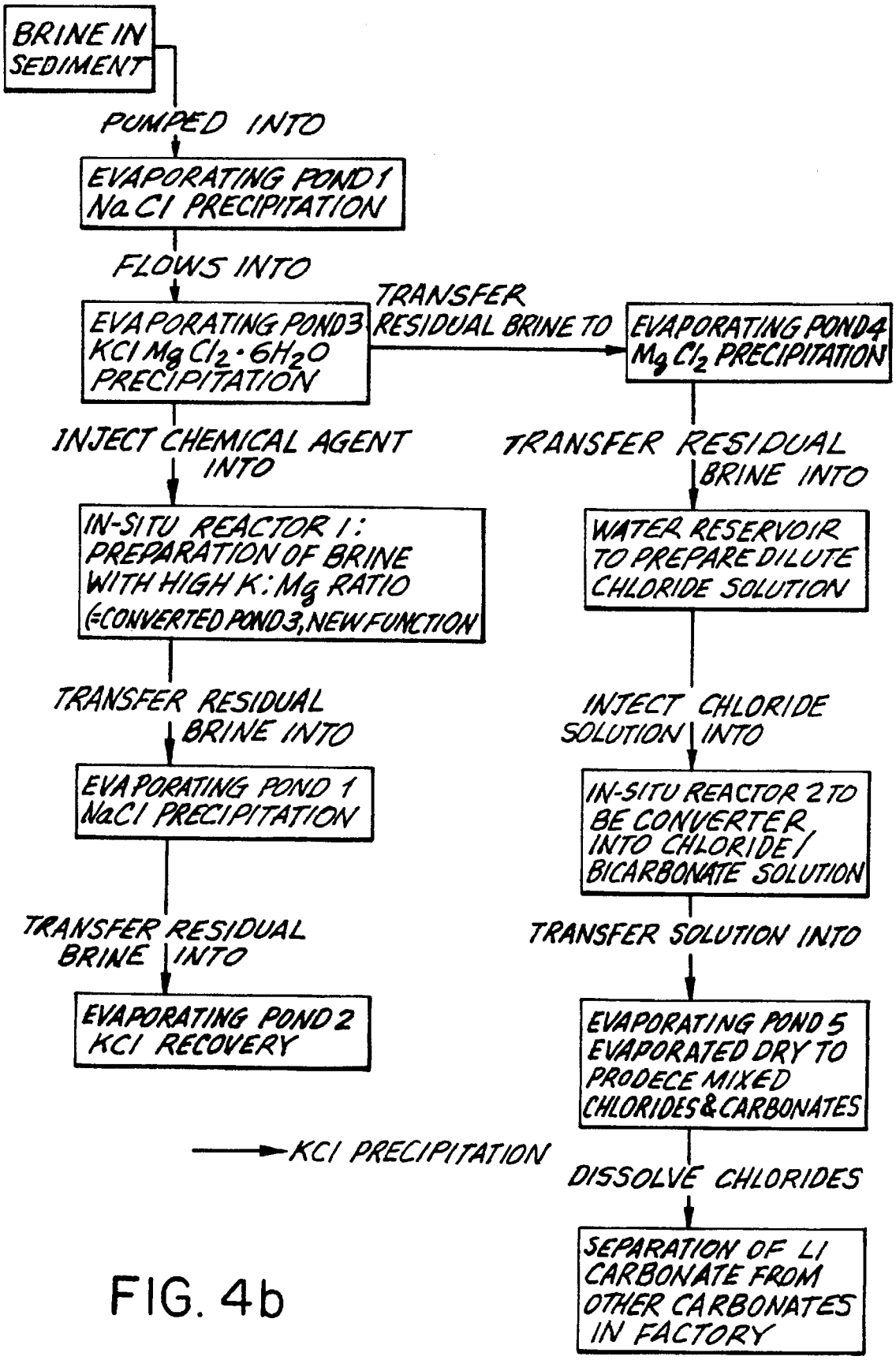
FIG. 4*b* is a flow chart showing the treatment of brine (very low K/Mg ratio).

For recovery of K and Li from brines in the Qaidam region of China, the process is shown diagrammatically by FIGS. 4*a* and 4*b*. The steps in the process consist of:

1. Removing Mg

For brines with K:Mg ratio of about 1:1, the brine can be fed directly from the underground source to In-situ Reactor 1 as described below (FIG. 4*a*).

Natural brines commonly have a K:Mg ratio considerably less than 1, e.g. Qaidam brines have a ratio of 1:20. A brine with a low K:Mg ratio is first prepared through the evaporative precipitation of $KCl.MgCl_2{\cdot}6H_2O$ by conventional means in Evaporating Pond 3 (FIG. 4*b*). The residual brine enriched with Mg is drained from the evaporating pond, thus removing much of the Mg from the system (step 1) and can be used for Li-production as described afterwards.

Evaporating Pond 3 is lined with a gravel or coarse sand layer at the bottom and isolated from ground contact by plastic sheets or other water barrier means and if necessary, with an overlying chemical filter layer. After the $KCl.MgCl_2{\cdot}6H_2O$ is precipitated above the gravel (and/or the chemical filter), a chemical solution is pumped into the gravel. Such a chemical solution can be made from the dissolution of trona mud by fresh or brackish water. Alternatively, a carbonic acid solution could be pumped into the gravel. The solution rises to acidify a layer of powdered limestone between the gravel and the K/Mg mixed-salt precipitate, where dissolved bicarbonate is to be used as the chemical agent to remove Mg from the mixed salt. As the solution rises under the pump pressure into the K/Mg precipitate, KCl is dissolved from the mixture, while the Mg reacts with the solution to form hydrous magnesium carbonate ($MgCO_3 \cdot xH_2O$). Thus, Evaporating Pond 3 serves the function of an In-situ Reactor 1 to remove Mg from the brines (production of KCl). Because of the dissolution processes, the flow of the solution through the chemical filter is not impeded, because the permeability of the solid medium is increased by dissolution.

The filtered brine, which now contains mostly dissolved KCl and NaCl (or $CaCl_2$) from In-situ Rector (converted from Evaporating Pond 3), is pumped into an Evaporating Pond 1 for further processing in step 2.

After the chemicals which line the bottom of the In-situ Reactor are completely converted into hydrous magnesium carbonate, the residue in the reactor can be removed. If necessary, a layer of new chemical is placed above the gravel layer in the reactor. The pit can again be used as an Evaporating Pond 3 for the precipitation of $KCl.MgCl_2 \cdot 6H_2O$. The magnesium carbonate from the reactor can be processed to make magnesium cement, or periclase (MgO), as local needs demand.

2. Removing Na

Evaporating Pond 1 is constructed according to local climatic conditions to provide appropriate evaporation.

Brine which contain mostly dissolved K and Na chloride from In-situ Reactor 1 is introduced into and concentrated in Evaporating Pond 1 by natural evaporation until NaCl is almost completely precipitated from solution.

3. Recovering KCl

The residual brines following step 2 are transferred to Evaporating Pond 2 for further natural evaporation. KCl is precipitated from the brine and is recovered (step 3). KCl precipitation is terminated if and when KCl $MgCl_2 \cdot 6H_2O$ is about to precipitate, as the Mg-removal may not have been complete.

4. Production of Li:

Mg is removed from brines drained from Evaporating Pond 3. The residual brine which is drained (during step 1) from Evaporating Pond 3 is transferred to Evaporating Pond 4 for further evaporation (step 4). Mg Cl2 is precipitated and thus the residual brine is depleted in Mg and enriched in Li.

5. Conversion of a chloride brine into a bicarbonate solution

The residual brine following step 4 is transferred to a water reservoir. A dilute chloride solution is prepared by mixing the residual brine with fresh or slightly brackish water to provide a dilute solution having a concentration of several percent.

In-situ Reactor 2, having dimensions similar to In-situ Reactor 1 (=converted Evaporating Pond 3), is constructed with a water reservoir for introduction of dilute chloride solution into Reactor 2. The bottom of the In-situ Reactor is lined with clean gravel or coarse sand to facilitate movement of water through the chemical filter.

The filter should be a layer of trona mud to convert the dilute chloride solution into a bicarbonate solution through a gradual dissolution of the trona mud.

5. Recovery of lithium carbonate

The bicarbonate solution from In-situ Reactor 2 is introduced into Evaporation Pond 5 and evaporated to dryness so that Mg, Na, K are mainly precipitated as chlorides, and Li mainly as carbonate.

The chloride is removed by dissolution. The residue should be carbonate of Li, mixed with Mg and Na carbonates. The lithium carbonate can be refined by conventional methods.

The various detailed procedures to install an in-situ reactor for the exploitation of metals and salts are exemplified by the following examples:

EXAMPLE 1

Recovery of Potassium Salt Through Direct Precipitation of KCl from Mg-rich Brines.

Where chloride brines are enriched with potassium, sodium, and magnesium, the process involves direct KCl precipitation by evaporation resulting in (a) the removal of magnesium, (b) the removal of sodium, and (c) the recovery of KCl. The process requires that a minimum of one in-situ reactor and two evaporating ponds be constructed for serial production. The specifications and their functions are described as follows:

(a) Removal of $Mg^{2+}$ in In-situ Reactor 1

In-situ Reactor 1 having dimensions of 33m ×33m in area and a depth of about 1 m or more below the groundwater table, or about 3 m below the surface is constructed. The pit wall is lined with plastic or with fabric to make it impermeable. The bottom of the pit is lined with a layer of gravelly sand 5–10 cm. thick. The gravelly sand is covered by a chemical filter layer of trona mud or dolomite powder about 15–20 cm. thick; the filtering layer serving to remove Mg from brine. The thickness of the filter can vary so as to obtain optimum rate of flow.

The brine filling the open pit should be approximately several meters deep, but the water level should be lowered by pumping when movement into the pit is desired. The flow rate is maintained at a slow enough rate through the chemical filter so for optimum Mg removal:

i) Use trona mud, either as a filler or as an aqueous solution filtering through K/Mg salt to remove magnesium, as previously described, the trona mud being particularly suitable for use with brines low in sulfate ion.

ii) Use powdered limestone to be acidified by carbonic acid as the agent to remove Mg as described previously;

If the efficiency of the Mg removal is too low because the flow rate is too high, the brines may be pumped to a brine-reservoir (tower) to be reintroduced into the gravel layer for recycling until the K:Mg ratio is increased to a value greater than 5:1.

If the flow rate is too low, as the permeability of the chemical in the filter is decreased by Mg/Na replacement, the trona mud (or dolomite) is mixed in the filtering layer lining the pit with NaCl, so that the filter contains a mixture with NaCl in the mud. Water reservoirs, several meters high and a few meters in diameter, should then be constructed, with pumping system to facilitate mixing with brines to be introduced into the gravelly sand at the bottom of the in-situ reactor. Alternatively, fresh water can be introduced directly into the gravelly sand below the in-situ reactor (driven by the gravity head of the water reservoir) into the gravelly layer to dilute the brine to keep its concentration considerably below NaCI saturation. Brine thus diluted, filtering through the trona mud NaCl mixture, should dissolve NaCl in the trona mud so that the permeability of the filter can be kept at a optimum value.

Another means to facilitate the filtering of brine through the chemical filter layer is to form an interlaminated deposit of the reacting filter chemical and permeable sand in the bottom of the pit; the interlamination can be produced through an alternate deposition of a layer of reacting filter chemical and a layer of sand. This arrangement is particularly suitable if there is considerable cementation caused by chemical reactions as a brine is filtered through the chemical filter layer.

After the chemical filter layer is no longer reactive with the magnesium ion of the brine, new chemical filter material can be placed into the pit, after the spent chemical is removed.

The chemical for the filter in the in-situ reactor is selected because it has the ability to effect ion-exchange to remove magnesium ion from brines. Sodium carbonates ($Na_2CO_3 \cdot NaHCO_3$) are particularly suitable, because of their fast reaction rate and because the sodium ion exchanged could eventually be removed as NaCl by fractional evaporation. For the sake of economy, a trona mud ($Na_2CO_3.NaHCO_3\ 2H_2O$) rather than the pure compound is preferred. To economize even further, the use of powdered limestone is preferred, and it is especially suitable for brines with high concentrations of sulfate ion which could then be precipitated by the calcium released by ion-exchange from the limestone.

(b) Removal of Na+ ions in Evaporating Pond 1

The filtered brine from In-situ Reactor 1 is pumped into Evaporating Pond 1. The dimension of the pond depends upon the brine inflow rate from the In-situ Reactor, the evaporation rate, and the production volume. Typical evaporating ponds in Qaidam have dimensions of 100 m ×300 m ×2 m.

By means of solar evaporation, sodium ions in the brine are removed by precipitation as sodium chloride.

(c) Recovery of KCl in Evaporating Pond 2

The residual brine from Evaporating Pond 1 is drained into Evaporating Pond 2, which may have dimensions similar to those of pond 1.

Potassium ion from the brine is precipitated as KCl because of the relatively high K:Mg ratio of the brine. Recovery should proceed until the K:Mg ratio of the brine is reduced so that KCl—$MgCl_2 \cdot 6H_2O$ is about to be precipitated.

(d) Recovery of $KCl.MgCl_2 \cdot 6H_2O$ in Evaporating Pond 3

If the residual brine from the Evaporating Pond 2 still contains some K ions, it can be introduced into an Evaporating Pond 3 having similar dimensions. Potassium ion in this brine of a higher K:Mg ratio is precipitated as $KCl.MgCl_2 \cdot 6H_2O$, which can be recovered and refined in the factory for KCl as is currently done.

The procedure (d) to recover $KCl.MgCl_2 \cdot 6H_2O$ is particularly suitable for those salt-works where facilities are available to separate potassium and magnesium from the mixed salt.

EXAMPLE 2

Recovery of Lithium Salt Through Precipitation of Lithium Carbonate from K—Mg Rich Chloride Brines.

In arid regions such as the Qaidam Basin of Northwest China, potassium-rich brines enriched in magnesium and sodium, may contain lithium in sufficient quantity so that lithium can be economically recovered. Lithium is presently extracted by solar evaporation from fresh water or brines. The Qaidam brines are, however, chloride rich, also containing in some instances significant concentrations of sulphate-ions. Such chloride brines may be converted into bicarbonate solution so that lithium can be recovered as lithium carbonate by means of the "in-situ reactors". Before the brine composition is changed by chemical reactions in the in-situ reactor, KCl can be recovered as a commercial by-product by the process described in Example 1.

The procedure to install "in-situ reactors" for lithium recovery is as follows:

(a) Removing Na and recovering KCl to produce residual brine enriched in Mg and Li KCl is precipitated as a by-product of lithium production, according to the process described in Example 1. During Step 1 of the process, the residual brine in Evaporating Pond 3 of KCl $MgCl_2.6H_2O$ precipitation is depleted in K, enriched in Mg and somewhat enriched in Li, as described previously.

(b) Removing Mg

The residual brine from Evaporating Pond 3 is transferred to Evaporating Pond 4 for further natural evaporation. The residual brine, after $McCl_2$ precipitation is depleted in Mg and further enriched in Li, as described previously.

(c) Converting chloride brine into dilute solution

The residual brine from Evaporating Pond 4 is transferred to a water reservoir. A dilute chloride solution is prepared by mixing the residual brine with fresh or slightly brackish water to provide a dilute chloride solution.

(d) Converting a chloride solution into a chloride/bicarbonate solution.

The dilute chloride solution is injected into an In-situ Reactor 2.

In-situ Reactor 2 is constructed with dimensions similar to those of In-situ Reactor 1, with a water tank, where evaporated brine from Evaporating Pond 4 has been diluted to produce a dilute chloride solution. This solution is then introduced into the Reactor 2. The bottom of this in-situ reactor should be lined with clean gravel to facilitate movement of water upward through the filter. The hydrodynamic gradient influencing the flow rate could be adjusted by pumping water out of the pit of the In-situ Reactor 2.

The chemical filter layer lining the bottom of the reactor pit should be a layer of bicarbonate salt. The dilute chloride solution from the water tank near In-situ Reactor 2 could flow under its gravity head, or be pumped, into the gravel layer at the very base of the in-situ reactor. The solution then ascends through the chemical filter layer and enters the pit. Through the dissolution of the carbonate salt in the filter, the dilute solution becomes a saturated bicarbonate solution, with subordinate chloride and sulfate ions.

Sodium carbonates, such as trona muds, are recommended as a filtering chemical for use in In-situ Reactor 2 because of the high solubility and fast dissolution rate. Powdered limestone ($CaCO_3$), can be used as the filtering chemical if the dilute solution prepared from the dilution of brines from Evaporating Pond 4 is acidified by carbonic acid to increase the solubility and dissolution rate. The use of calcium carbonate is not only economical, it also has the advantage of depleting the sulfate concentration of the solution.

e) Recovery of Lithium carbonate

The bicarbonate solution from In-situ Reactor D is introduced into Evaporating Pond E and evaporated to dryness so that Mg, Na, K are precipitated mainly as chlorides, and Li mainly as carbonate.

The chloride is removed by dissolution. The residue should be a carbonate of Li, mixed with Mg and Na carbonates. The lithium carbonate can be refined by conventional method.

EXAMPLE 3

Recovery of Gold from Carlin (Nev.)-type Deposits.

Organic-rich metalliferous rocks contain appreciable amounts of disseminated gold and associated metals, such silver, mercury, arsenic, antimony, etc., have been called the Carlin-type deposit. Black shales containing appreciable amount of disseminated uranium, and associated metals such as vanadium, molybdenum, nickel, etc., have been called the Chattanooga-type deposit. These organic-rich metalliferous sedimentary rocks (shales, mudstones) are relatively impermeable.

The Carlin gold deposit was discovered and first mined in the 1960s. Those ores, containing 7 or 10 grams of gold per ton in oxidized, leached rocks, could be mined by conventional methods of excavating the metalliferous rocks and extracting the gold from the excavated and mined ores by dilute (10 parts per million) cyanide solutions. The current mining processes are, however, so costly that the gold deposits below the oxidized, leached zones cannot be economically mined. Mineral reserves of low-grade gold are, however, immense. Nevada, for example, was estimated in 1990 to have a reserve of 3900 metric tons. With the process of the present invention, many such low-grade deposits can be economically recovered.

The reasons why the Carlin-type deposits below the oxidized, leached zone cannot be recovered by conventional practices are threefold:

(1) the ore-bearing rock is too impermeable for injected leaching solutions to penetrate into the ore body;

(2) the ore deposit contains too much organic matter and/or metallic sulfides which render ineffective the leaching solutions;

(3) the hydrological framework of the region may lead to contamination of groundwaters by leaching solutions injected into the orebody.

Recovery of desired metals such as gold from the Carlin or Chattanooga type deposits can be accomplished by first fracturing and retorting organic-rich shale, i.e., shale burning using presently available means and then converting the ore-bearing host rock into an in-situ reactor so that the leaching solution can be injected into the reactor to dissolve the metals present therein. The in-situ reactors are constructed so that the flow path of injected fluids is controlled and the solvents used for leaching ore metals do not contaminate or pollute groundwaters.

The procedure for working Carlin-type gold deposits, as an example, is described as follows:

(i) Fracturing and retorting organic shale

The current methods of shale burning, developed for the purpose of extracting hydrocarbons from oil shales, are first applied to a deposit. A cavity is excavated underground where the rock 21 can be ignited and into which oxygen, and in some instances fuel, are introduced to sustain the shale burning Suitable processes are described in U.S. Pat. Nos. 3,894,769, 4,043,595, 4,162,808, 4,192,552, 4,243,100, 4,436,344 and 4,444,256. To increase the porosity and permeability of the rock for more effective shale burning, various methods of explosion fracturing and hydrofracturing have been employed. Suitable processes are described in U.S. Pat. Nos. 4,085,971, 4,210,366, 4,239,286, 4,522,260, GB-Patent 1,482,024, 3,917,345, 4,487,260, 4,444,258, 4,522,265, 4,869,322, 5,228,510 and 4,487,260.

Thus, through a combination of current methods of fracturing and shale burning, an impermeable ore-bearing, organic-rich, host-rock can be converted into a porous and permeable oxidized "in-situ reactor" as hereafter described. It should first be noted that any in-situ combustion must terminate prior to the solution mining described below.

A borehole is drilled to depth z. Fluid is pumped under high pressure to a zone t, z meters below the surface to fracture the rocks in the zone by hydrofracturing. Fracture surfaces will radiate from the borehole, and flammable material will be pumped into the hole to ignite the burning of organic-rich shale. Oxygen is pumped into the hole to sustain the burning, and the organic material in the rock is the fuel for the fire. Additional fuel can be introduced if the organic matter in the rock is not sufficient. The zone of "shale burning" which has a thickness t down to z meters below the surface can be controlled by the so-called "floor-block material" as described in U.S. Pat. No. 4,478,282. Holes 24 can be drilled on the periphery of the shale-burning zone to release the exhaust gases produced by shale burning. Hydrocarbons produced by burning can be collected through the application of conventional methods such as described in U.S. Pat. No. 4,369,842. The shale burning can be extended from the original borehole outward until the entire ore-body to be exploited is burnt.

The porous and permeable burnt rock, surrounded on all sides and surrounded below by impermeable, organic-rich rock which is not burnt, is the in-situ reactor 22, into which leaching solution can be injected.

ii) Solution mining by leaching fluid moving under hydrodynamic gradient through the in-situ reactor.

The current solution-mining methods employed to process such shales inject leaching fluid into porous and permeable strata, and the fluid moves laterally under a pressure gradient. Boreholes are drilled on the periphery of the injection zone, and leaching fluid is pumped into the holes 24 under high pressure. The fluid flows then into a borehole at the center of the zone, where the ore-bearing solution is collected and pumped out for refining.

The present invention introduces a method of moving fluids vertically upward through a mass of burnt, but still not very permeable rock. Boreholes for injecting leaching solution are drilled on the periphery of the zone of shale burning, i.e., the in-situ reactor 22. As shown in FIGS. 5 and 6, instead of one collecting borehole in the center, one or more shallow collecting ponds are dug above the burning zone. By lowering the water level within the pond 23, a vertical hydrodynamic gradient is produced, so that the injected fluid is induced to move upward into the pits. The hydrodynamic gradient influencing the rate of the flow can be varied by lowering the water-level within the ponds (by pumping water out of pond); the greater the level of water in a pond beneath the groundwater table, the greater is the hydrodynamic gradient and thus rate of the vertically upward flow movement. The rate can further be adjusted by varying the pressure of injection-fluid. Because of the much greater cross-sectional area normal to the path of vertical flow, the quantity of leaching fluid flowing vertically upward is much more than that flowing laterally, and the leaching is rendered more efficient.

To extract gold from the Carlin type of deposit, very dilute cyanide solution ($CN^-$) has to be used. Although a concentration of 10 ppm is so small that it could not lead to great health hazard, the toxicity of the fluid is nevertheless so notorious that in-situ solution mining of gold is commonly prohibited because of fear of groundwater contamination by cyanide. The present invention has the advantage that the injected fluid is forced to move through the porous and permeable in-situ reactor to the collecting ponds in the center of the zone of shale burning. Hardly any injected fluid could penetrate into the impermeable, organic-rich host rock surrounding the in-situ reactor. The negligible amount of the injected fluid that might move sideways into the unoxidized organic-rich host rock is immediately detoxified, because cyanide solution is easily neutralized by the organic compounds in the organic-rich host rock. Solution mining by injecting fluids into an in-situ reactor will, therefore, not constitute an environmental hazard. Furthermore, since the ores are not excavated but extracted by solution, the mine areas will not be polluted by the dumping of tailings. Instead, the collecting ponds can be refilled and seeded in the depressions into which groundwater flows. Ponds 23 are initially filled to $h_0$ and subsequently refilled from $h_1$ to $h_0$ automatically due to the difference in hydrodynamic potential of the fluid column in the boreholes and the fluid column in the pond.

iii) Solution containing ore-metal, such as gold, is collected and pumped out of collecting ponds to be processed in factory by conventional refining methods.

Although the present invention has been described with pretense and embodiments, it is to be understood that modifications and variations may be resorted to without departing from the scope of the invention, reference being had to the appended claims for a full definition of the scope of the invention.

What is claimed is:

1. A process for recovering salts and metals from fluid ore-deposits comprising the step of inducing hydrodynamic flow of a salt- or metal-bearing solution through a chemical filter layer into a natural or artificial basin having walls and a floor constructed on a deposit site bearing desired metals or salts, said chemical filter layer being located on said floor, said floor of said basin lying below the groundwater table and the flow rate is regulated through a change of the hydrodynamic gradient, to promote chemical reaction between the fluid and the chemicals in the basin and thereafter separating the reactor product.

2. The process according to claim 1 wherein the hydrostatic gradient is changed by lowering the water level in the basin.

3. The process according to claim 1 wherein the hydrostatic gradient is changed by elevating the groundwater table.

4. The process according to claim 1 wherein said solution flowing through chemical layer on the floor of said basin is rich in dissolved ions wherein the undesirable ions are removed by the chemical reaction between the fluid and the chemical layer.

5. The process according to claim 1 wherein said solution flowing through said chemical filter layer on the floor of said basin is rich in dissolved ions wherein the desired ions are extracted by said chemical filter layer.

6.The process according to claim 1 wherein the chemical layer at the bottom of said basin contains a mixture of soluble salt which is dissolved by the fluid flowing through, wherein said chemical layer is kept permeable.

7. The process according to as claim 1, wherein trona mud or limestone is used as the chemical in said chemical filter to remove Mg-ion in a brine so that potassium-exploitation in the form of direct KCl precipitation by evaporation is possible.

8. The process according to claim 5, wherein said solution being a chloride solution having lithium, and wherein said fluid ore-deposits being included in brine which is subsequently converted into a bicarbonate solution through reaction with trona or other carbonates in the chemical layer at the bottom of the basin so that said lithium could eventually be precipitated as a carbonate and be refined by conventional method.

9. The process of claim 1 wherein the chemical filter layer is trona mud or limestone, to convert a chloride solution into a chloride/bicarbonate solution.

10. A process for recovering metals from an ore bearing body comprising the steps of:

subjecting said ore bearing body to shale burning to oxidize said ore beating body to enable fluid to permeate and to react with said ore-beating body;

recovering said metals from said burnt, ore-bearing body by subjecting said burnt ore beating body to leaching by inducing hydrodynamic flow of a leaching solution through said body lying below a groundwater table, the flow rate being regulated through a change of the hydrodynamic gradient, and thereafter separating said metals from the reaction product.

11. The process according to claim 10 wherein fuel is injected into said body to help initiate said shale burning.

12. The process according to claim 10, wherein fuel is injected into said body to help maintain said shale burning.

* * * * *